US005924501A

United States Patent [19]

Tibbitts

[11] Patent Number: 5,924,501

[45] Date of Patent: Jul. 20, 1999

[54] PREDOMINANTLY DIAMOND CUTTING STRUCTURES FOR EARTH BORING

[75] Inventor: Gordon A. Tibbitts, Salt Lake City, Utah

[73] Assignee: Baker Hughes Incorporated, Houston, Tex.

[21] Appl. No.: 08/602,050

[22] Filed: Feb. 15, 1996

[51] Int. Cl.[6] ..... F21B 10/46

[52] U.S. Cl. ..... 175/429; 175/432

[58] Field of Search ..... 175/428, 432, 175/434, 429, 430, 431, 433; 51/307, 297

[56] References Cited

U.S. PATENT DOCUMENTS

| | | | |
|---|---|---|---|
| Re. 32,036 | 11/1985 | Dennis . | |
| 3,745,623 | 7/1973 | Wentorf, Jr. et al. . | |
| 4,109,737 | 8/1978 | Bovenkerk . | |
| 4,323,130 | 4/1982 | Dennis . | |
| 4,381,825 | 5/1983 | Radtke . | |
| 4,396,077 | 8/1983 | Radtke . | |
| 4,410,054 | 10/1983 | Nagel et al. . | |
| 4,442,909 | 4/1984 | Radtke . | |
| 4,478,298 | 10/1984 | Hake et al. . | |
| 4,494,618 | 1/1985 | Radtke . | |
| 4,498,549 | 2/1985 | Jürgens . | |
| 4,499,795 | 2/1985 | Radtke . | |
| 4,499,958 | 2/1985 | Radtke et al. . | |
| 4,511,006 | 4/1985 | Grainger | 175/432 |
| 4,545,441 | 10/1985 | Williamson . | |
| 4,592,433 | 6/1986 | Dennis . | |

(List continued on next page.)

FOREIGN PATENT DOCUMENTS

| | | | |
|---|---|---|---|
| 0 219 959 A2 | 9/1986 | European Pat. Off. . | |
| 0 411 831 A1 | 7/1990 | European Pat. Off. . | |
| 0480 895 A2 | 10/1991 | European Pat. Off. . | |
| 2115460 | 9/1983 | United Kingdom | 175/431 |
| 2240797 | 8/1991 | United Kingdom . | |
| 2193740 | 2/1998 | United Kingdom . | |

OTHER PUBLICATIONS

IBM technical diclosure bulletin, vol. 13, No. 11, Apr. 1971.

Ortega et al., "Frictional Heating and Convective Cooling of Polycrystalline Diamond Drag Tools During Rock Cutting," SPE, 1982.

Letter of May 17, 1996 from Daniel McCarthy to Joseph A. Walkowski regarding "US Synthetic MXD Cutter and Prior Art" (5 pages) with eleven (11) pages of attachments including a table entitled "U.S. Synthetic Large Chamfer Products" (1 page) and ten (10) pages of undated drawing designated, in the order set forth in the table and following therebehind, as 1303RC–DSC, 1308RC–DSC, 1908RC–DSC, 0808FMT, 1303FMT, 1308FMT, 1908FMT, 1308F Shaped, 1313RC S–CHM, 1913RC S–CHM.

Letter of May 31, 1996 from Daniel McCarthy to Joseph A. Walkowski regarding "US Synthetic and MXD Cutters" (3 pages) with attachments 1 through 8.

Letter (4 pages) dated Nov. 27, 1998 from Lloyd Sadler to Joseph A. Walkowski transmitting and commenting on accompanying drawings, invoices and photographs (24 pages) of PDC cutters.

*Primary Examiner*—Hoang Dang

*Attorney, Agent, or Firm*—Trask, Britt & Rossa

[57] ABSTRACT

A diamond cutting element for use on an earth boring drill bit, such as a rotary drag bit. The cutting element is predominately comprised of a diamond cutting structure attached to either a reduced-volume substrate or directly to a bit body, optionally using a carrier structure mounted to the bit body. With such a configuration, stress between dissimilar materials, such as the substrate and the cutting structure, is reduced or entirely eliminated. Moreover, only the diamond cutting structure contacts the formation during drilling, resulting in lower friction, lower temperatures and lower wear rates of the cutting elements. The diamond cutting structure may also be polished and include one or more internal passageways that extend into the diamond through which fluids may be passed to transfer heat from the cutting element during drilling.

32 Claims, 5 Drawing Sheets

U.S. PATENT DOCUMENTS 4,593,777 6/1986 Barr .
4,604,106 8/1986 Hall et al. ..... 51/297
4,606,418 8/1986 Thompson ..... 175/429
4,607,711 8/1986 Zijsling .
4,632,196 12/1986 Dennis .
4,690,691 9/1987 Komanduri .
4,702,649 10/1987 Komanduri .
4,705,123 11/1987 Dennis .
4,714,385 12/1987 Komanduri .
4,724,913 2/1988 Morris .
4,729,440 3/1988 Hall .
4,764,434 8/1988 Aronsson et al. .
4,784,023 11/1988 Dennis .
4,792,001 12/1988 Zijsling .
4,797,138 1/1989 Komanduri .
4,858,707 8/1989 Jones et al. .
4,861,350 8/1989 Phaal et al. .
4,869,330 9/1989 Tibbitts .
4,871,377 10/1989 Frushour ..... 51/309
4,872,520 10/1989 Nelson .
4,926,950 5/1990 Zijsling .
4,976,324 12/1990 Tibbitts .
4,984,642 1/1991 Renard et al. .
4,987,800 1/1991 Gasan et al. .
5,011,515 4/1991 Frushour .
5,016,718 5/1991 Tandberg .
5,027,912 7/1991 Juergens .
5,028,177 7/1991 Meskin et al. ..... 175/430
5,045,092 9/1991 Keshavan .
5,054,246 10/1991 Phaal et al. .
5,103,922 4/1992 Jones .
5,119,714 6/1992 Scott et al. .
5,120,327 6/1992 Dennis .
5,127,923 7/1992 Bunting et al. .
5,135,061 8/1992 Newton, Jr. .
5,154,245 10/1992 Waldenström et al. .
5,159,857 11/1992 Jurewicz .
5,161,627 11/1992 Burkett .
5,173,090 12/1992 Scott et al. .
5,199,512 4/1993 Curlett .
5,238,074 8/1993 Tibbitts et al. .
5,248,006 9/1993 Scott et al. .
5,264,283 11/1993 Waldenström et al. .
5,273,125 12/1993 Jurewicz .
5,279,375 1/1994 Tibbitts et al. .
5,287,936 2/1994 Grimes et al. .
5,291,957 3/1994 Curlett .
5,301,762 4/1994 Besson .
5,314,033 5/1994 Tibbitts .
5,316,095 5/1994 Tibbitts .
5,332,051 7/1994 Knowlton .
5,335,738 8/1994 Waldenström et al. .
5,337,844 8/1994 Tibbitts .
5,346,026 9/1994 Pessier et al. .
5,351,772 10/1994 Smith .
5,355,969 10/1994 Hardy et al. .
5,370,717 12/1994 Lloyd et al. .
5,379,853 1/1995 Lockwood et al. .
5,379,854 1/1995 Dennis .
5,433,280 7/1995 Smith .
5,435,403 7/1995 Tibbitts .
5,437,343 8/1995 Cooley et al. .
5,443,565 8/1995 Strange, Jr. .
5,447,208 9/1995 Lund et al. .
5,460,233 10/1995 Meany et al. .
5,467,836 11/1995 Grimes et al. .
5,472,376 12/1995 Olmstead et al. ..... 175/428
5,492,188 2/1996 Smith et al. ..... 175/432
5,499,688 3/1996 Dennis .
5,590,729 1/1997 Cooley et al. ..... 175/432
5,605,199 2/1997 Newton ..... 175/432
5,662,720 9/1997 O'Tighearnaigh ..... 51/295

PREDOMINANTLY DIAMOND CUTTING STRUCTURES FOR EARTH BORING

BACKGROUND

1. Field of the Invention

The present invention relates generally to superabrasive cutting elements, and more specifically to polycrystalline diamond compact cutting elements, comprised substantially of diamond optionally bonded to a reduced-mass supporting substrate.

2. State of the Art

Fixed-cutter rotary drag bits have been employed in subterranean drilling for many decades, and various sizes, shapes and patterns of natural and synthetic diamonds have been used on drag bit crowns as cutting elements. Rotary drag-type drill bits are typically comprised of a bit body having a shank for connection to a drill string and encompassing an inner channel for supplying drilling fluid to the face of the bit through nozzles or other apertures. Drag bits may be cast and/or machined from metal, typically steel, or may be formed of a powder metal (typically WC) infiltrated at high temperatures with a liquified (typically copper-based) binder material to form a matrix. It is also contemplated that such bits may be formed with so-called layered manufacturing technology, as disclosed in U.S. Pat. No. 5,433,280, assigned to the assignee of the present invention and incorporated herein by this reference.

The bit body typically carries a plurality of cutting elements mounted directly on the bit body or on a carrier element. Cutting elements may be secured to the bit by preliminary bonding to a carrier element, such as a stud, post, or cylinder, which in turn is inserted into a pocket, sachet, recess or other aperture in the face of the bit and mechanically or metallurgically secured thereto. Polycrystalline diamond compact (PDC) cutting elements may be brazed directly to a matrix-type bit or to a pre-placed carrier element after furnacing, or even bonded into the bit body during the furnacing process. It has also been suggested that PDC cutting elements may be adhesively bonded to the bit face or to a carrier element.

For over a decade, it has been possible to process diamond particles into larger disc shapes. The discs, or diamond tables, are typically formed of sintered polycrystalline diamond, the resulting structure being freestanding or bonded to a tungsten carbide layer during formation. A typical PDC diamond table/WC substrate cutting element structure is formed by placing a disc-shaped cemented carbide substrate including a metal binder such as cobalt into a container or cartridge of an ultra-high pressure press with a layer of diamond crystals or grains loaded into the cartridge adjacent one face of the substrate. A number of such cartridges are typically loaded into a press. The substrates and adjacent diamond crystal layers are then compressed under ultra-high temperature and pressure conditions. These conditions cause the metal binder from the substrate body to become liquid and sweep from the region behind the substrate face next to the diamond layer through the diamond grains to form the polycrystalline diamond structure. As a result, the diamond grains become mutually bonded to form a diamond table over the substrate face which is bonded to the substrate face. The spaces in the diamond table between the diamond-to-diamond bonds are filled with residual metal binder. It is also possible to form freestanding (no substrate) polycrystalline or monocrystalline diamond structures, providing another source of binder is employed, as is known in the art. For example, powdered binder may be intermixed with the diamond grains.

A so-called thermally stable PDC product (commonly termed a TSP) may be formed by leaching out the metal in the diamond table. Alternatively, silicon, which possesses a coefficient of thermal expansion similar to that of diamond, may be used to bond diamond particles to produce an Si-bonded TSP. TSPs are capable of enduring higher temperatures (on the order of 1200° C.) without degradation in comparison to normal PDCs, which experience thermal degradation upon exposure to temperatures of about 750–800° C. TSPs are typically freestanding (e.g., without a substrate), but may be formed on a substrate. TSPs may also be coated with a single- or multi-layer metal coating to enhance bonding of the TSP to a matrix-body bit face.

Any substrate incorporated in the cutting element must sufficiently support the diamond table to curtail bending of the diamond or other superabrasive table attributable to the loading of the cutting element by the formation. Any measurable bending may cause fracture or even delamination of the diamond table from the substrate. It is believed that such degradation of the cutting element is due at least in part to lack of sufficient stiffness of the cutting element so that, when encountering the formation, the diamond table actually flexes due to lack of sufficient rigidity or stiffness. As diamond has an extremely low strain rate to failure, only a small amount of flex can initiate fracture.

PDC cutting elements, with their large diamond tables (usually of circular, semi-circular or tombstone shape), have provided drag bit designers with a wide variety of potential cutter deployments and orientations, crown configurations, nozzle placements and other design alternatives not previously possible with the smaller natural diamond and polyhedral, unbacked synthetic diamonds (usually TSPs) traditionally employed in drag bits. These PDC cutting elements, with their large diamond tables extending in two dimensions substantially transverse to the direction of cut have, with various bit designs, achieved outstanding advances in drilling efficiency and rate of penetration (ROP) when employed in soft to medium hardness formations, and the larger cutter dimensions and attendant greater protrusion or extension above the bit crown have afforded the opportunity for greatly improved bit hydraulics for cutter lubrication and cooling and formation debris removal.

Since the early days of PDC use on drill bits, however, it has been apparent that PDCs suffer thermal degradation at the high temperatures generated by the frictional abrasive contact of the PDC cutting edge with the formation as the bit rotates and weight is applied to the drill string on which the bit is mounted. Such degradation leads to premature dulling of the PDC cutting edge, and even gross failure of the PDC cutting element assembly. Improved feedstock and fabrication techniques have raised the thermal tolerance of PDCs to some degree. As noted above, there has been developed a subcategory of PDCs known as thermally stable products, or TSPs, which retain their physical integrity to temperatures approaching 1200° C. TSPs may be infiltrated into matrix body drill bits at the time of bit furnacing, rather than being attached at a later time, as with non-thermally stable PDCs. However, even TSPs suffer from thermal degradation during cutting of the formation as the drill bit advances the wellbore.

While the prior art has focused on problems associated with the degradation of the diamond layer or table, heating of the cutting element substrate (typically tungsten carbide) from the drilling operation is also detrimental to cutting element performance. Heat checking of the substrate, typically caused in one form by alternative heating and quenching of the cutting elements as the drill bit bounces on the bottom of the borehole and drilling fluid intermittently contacts the cutting elements at the cutting edges, can initiate more severe substrate cracking which, in turn, can propagate cracking of the diamond table.

A variety of attempts have been made to cool and clean PDC cutting elements during the drill operation by flushing the cutting elements with drilling fluid, or "mud," pumped down the drill string and through nozzles or other orifices on the face of the bit. The flow of drilling mud removes formation cuttings and other debris from the face of the bit and generally radially outwardly to the bit gage, up the junk slots and into the wellbore annulus between the drill string and the wall of the wellbore to the surface, where the debris is removed, the mud screened and reconditioned with additives and again pumped down the drill string. It is known in the art to direct drilling mud flow across the face of a series of cutting elements (U.S. Pat. No. 4,452,324 to Jürgens); to direct mud flow from a nozzle toward the face of a single cutting element (U.S. Pat. No. 4,303,136 to Ball); and to direct flow from a nozzle to a single cutting element at a specific orientation (U.S. Pat. No. 4,913,244 to Trujillo). It has also been proposed to direct mud flow through the face of a PDC cutting element from an internal passage extending from the interior of the drill bit through the carrier element and out an aperture in the face of the cutting element (U.S. Pat. No. 4,606,418 to Thompson).

It has also been proposed, in U.S. Pat. No. 4,852,671 to Southland, to direct drilling mud flow through a passage in a stud supporting a PDC to a relief between the pair of cutting points in the formation-contacting zone of a disc-shaped PDC cutting element to improve the cooling and cleaning of the cutting elements. Moreover, in U.S. Pat. No. 5,316,095 to Tibbitts, the cutting element is cooled with drilling fluid via a plurality of internal channels having outlets adjacent the peripheral cutting edge of the diamond cutting element.

In addition to degradation of the cutting element due to thermal effects, the interface of the diamond table with the substrate (typically tungsten carbide, or WC) is subject to high residual shear stresses arising from formation of the cutting element, as after cooling, the differing bulk moduli and coefficients of thermal expansion of the diamond and substrate material result in thermally-induced stresses. In addition, finite element analysis (FEA) has demonstrated that high tensile stresses exist in a localized region in the outer cylindrical substrate surface and internally in the WC substrate. Both of these phenomena are deleterious to the life of the cutting element during drilling operations, as the stresses, when augmented by stresses attributable to the loading of the cutting element by the formation, may cause spalling, fracture or even delamination of the diamond table from the substrate.

In addition to the foregoing shortcomings, state of the art PDCs often lack sufficient diamond volume to cut highly abrasive formations, as the thickness of the diamond table is limited due to the inability of a relatively thick diamond table to adequately bond to the substrate. Further, as the diamond table wears in the prior art cutting elements, more and more of the substrate material becomes exposed to the formation, increasing the so-called "wear flat" area behind the cutting edge of the diamond table and resulting in less-efficient cutting for a given weight on bit (WOB). Moreover, the frictional coefficient of diamond in contact with rock is much lower than that of the substrate material. Thus, as the wear flat increases, friction and frictionally-induced heating of the cutting element increase.

SUMMARY OF THE INVENTION

In contrast to the prior art, the cutting element of the present invention is comprised predominantly of diamond with a reduced size substrate or, in some embodiments, with no substrate. That is, the diamond cutting structure (commonly referred to as a diamond table) volume exceeds the volume of the substrate so that a substantially all-diamond cutting element is presented to the formation. In several of the preferred embodiments, the substrate is completely eliminated such that only the diamond cutting structure and, optionally, a carrier element are necessary for mounting the cutting structure to a drill bit. By removing, if not eliminating the substrate, stresses between dissimilar materials can be substantially reduced and heat transfer from the diamond enhanced.

It is preferred that the diamond table of the cutting element according to the present invention be quite robust in the vicinity of the cutting face, in comparison to prior art structures. For example, it is preferred that the diamond table be at least 0.150 inch thick, measured with respect to the longitudinal axis of the cutting element, at least in the vicinity of the cutting edge. Even thicker diamond tables are contemplated as within the scope of the invention, and may be preferred for use in some formations.

The use of large volumes or masses of diamond in the cutting element, particularly adjacent the formation being cut, provides for better heat transfer and provides more convective area for same. In addition, frictional forces are minimized in comparison to prior art cutting elements having substrates which quickly contact the formation due to wear flat development, minimizing heat generation and lowering required bit torque. Further, the presence of an all-diamond volume adjacent and to the rear of the cutting edge avoids the diamond/substrate interface stresses present during loading of prior art cutting elements. In addition, elimination of the carbide substrate minimizes residual stresses within the cutting element, producing a substantially "zero residual stress" cutting structure in a macro sense, the crystalline bond micro-stresses being substantially uniform and offsetting throughout the structure.

In some preferred embodiments, the cutting element of the invention comprises a solid, imperforate volume of diamond, which may be formed with or without an associated substrate element.

In various preferred embodiments, the cutting element of the present invention comprises a substantially hollow, cup-shaped cutting structure (i.e., diamond table) of circular, rectangular or other suitable cross-section comprising a PDC, TSP, or other superabrasive material bonded to a supporting substrate. Such a configuration helps transfer heat generated during the drilling process away from the cutting structure, while providing the required structural support necessary for the cutting element.

Because of the size of the diamond cutting structure and the high forces and stresses placed on the cutting structure during drilling, it may be desirable to chamfer, bevel, or taper the cutting edge of the cutting structure, that is, for a cylindrical cutting structure, to provide a frustoconical-inwardly tapered portion extending from a location on the periphery of the cutting structure to the cutting face. More than one chamfer or taper may also be used to provide additional support for the cutting edge and cutting face of the cutting structure. See, for example, U.S. Pat. No. 5,437,343, assigned to the assignee of the present invention and incorporated herein by this reference. The angle of such a taper or chamfer may be quite varied to either extreme, ranging from about 10° to approximately 80° with regard to the longitudinal axis of the cutting element, or to the sidewall if it parallels the axis. The longitudinal axis is defined as the axis extending generally transversely to the direction of cut, and transverse to the cutting face in the case of a cylindrical cutting element. Polishing exterior surfaces of the cutting structure may also help reduce friction during drilling and thus thermally induced stresses. U.S. Pat. No. 5,447,208, assigned to the assignee of the present invention, discloses cutting elements of reduced surface roughness and is hereby incorporated by this reference.

In some embodiments, the cutting element does include a substrate. The substrate, however, is relatively small in comparison to the size of the diamond cutting structure. The substrate may be substantially planar on both its front and back sides or include a raised portion or portions to mate with a recess or recesses formed in the mating end of the diamond cutting structure and/or a carrier element.

In several of the preferred embodiments, the diamond cutting structure includes several cavities formed therein extending longitudinally along a length of the diamond cutting structure. The cavities may be in the form of pie segment-shaped recesses or circular bores and preferably extend from a distal or trailing end of the cutting structure to a location behind the cutting face. Moreover, these internal cavities, passageways, or channels may then be placed in fluid communication with a carrier element on a bit body such that fluid may be passed from the bit body interior through the carrier to the interior of the cutting structure.

Other recesses may be formed in the distal end of the cutting structure to accommodate mating with a post, stud, or other carrier element which is formed or attached by means known in the art to the face of the rotary drag bit. This mating arrangement may be in the form of a male-female interconnection where the carrier extends into the recessed portion of the cutting structure such that the cutting structure "caps" the carrier, or where the carrier provides a circumferential sleeve to fit around the cutting structure. In addition, the fit between the carrier and the cutting structure may form one or more gaps or voids, also termed "chambers", such that a fluid passed through internal channels in the carrier to these voids or gaps can cool the cutting structure during drilling.

In another preferred embodiment of the invention, an attachment ring comprised of a hard material such as tungsten carbide may be bonded to the distal end of the cutting structure by means known in the art, such as brazing. This attachment ring could then be attached to the surface of a bit face or a carrier element. Similarly, an attachment sleeve could be attached to the outer perimeter of the cutting structure. For an attachment sleeve arrangement, the cutting structure could be mushroom-shaped such that the sleeve extends over the stem of the cutting structure and up to its cap. In this way, the sleeve would be shielded from the formation by the cutting structure during drilling.

While the preferred embodiments employ a substantially planar cutting face with a generally cylindrical outer surface, other partial, half or non-circular configurations such as so-called "tombstone" cutters and other shapes, including oval, square, rectangular, triangular or other polygonal shapes, are also contemplated. Additionally, other substantially planar diamond cutting faces, such as ridged, convex, concave, and combinations thereof, may also benefit from a cutter according to the present invention. The term "substantially planar" as used herein is intended only to describe a cutting face extending in two dimensions, and not as limiting the topography or shape of the cutting face itself.

It is believed that a major aspect of the present invention, regardless of the specific cutter shape, is the volume of the diamond cutting structure in absolute terms and relative to that of the substrate. In addition, a recessed portion or portions formed in the cutting structure to help cool the diamond cutter and provide a means for attachment of the diamond cutter are also significant. An all or substantially-all diamond cutter having a diamond table of increased depth in contact with a formation will wear in a vertical direction less than state-of-the-art cutting elements employing a thin diamond table of the same composition and on a conventional, larger-volume substrate, the reduced wear being a function of the greater surface area of diamond in contact with the formation provided by the greater diamond volume. Further, cutting elements of the invention may be cooled more easily, will stay sharper for a longer period of time, and will be less susceptible to stresses encountered during drilling in comparison to prior art cutting elements.

These and other advantages of the present invention, will become apparent from the following detailed description, the accompanying drawings, and the appended claims.

It should be noted that the terms "diamond," "polycrystalline diamond," or "PDC" as used in the specification and claims herein shall be interpreted as including all diamond or diamond-like cutting elements having a hardness generally similar to or approaching the hardness of a natural diamond, including without limitation PDCs, TSPs, diamond films, cubic boron nitride, and combinations thereof.

DETAILED DESCRIPTION OF THE ILLUSTRATED EMBODIMENTS

Figure 1B:
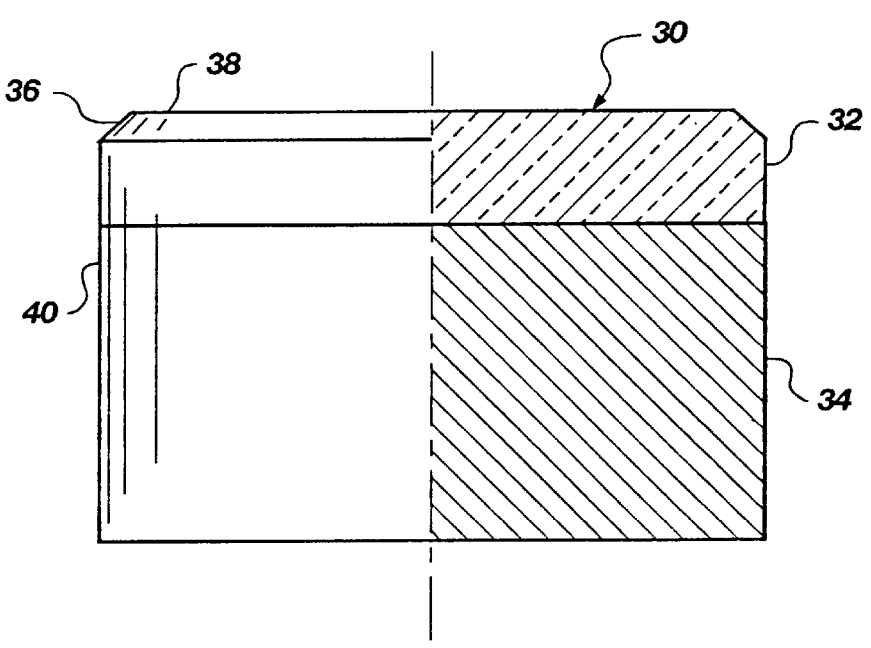
Fig. 1B (PRIOR ART)
FIG. 1B is a partial cross-sectional view of a prior art cutting element.
Figure 1A:
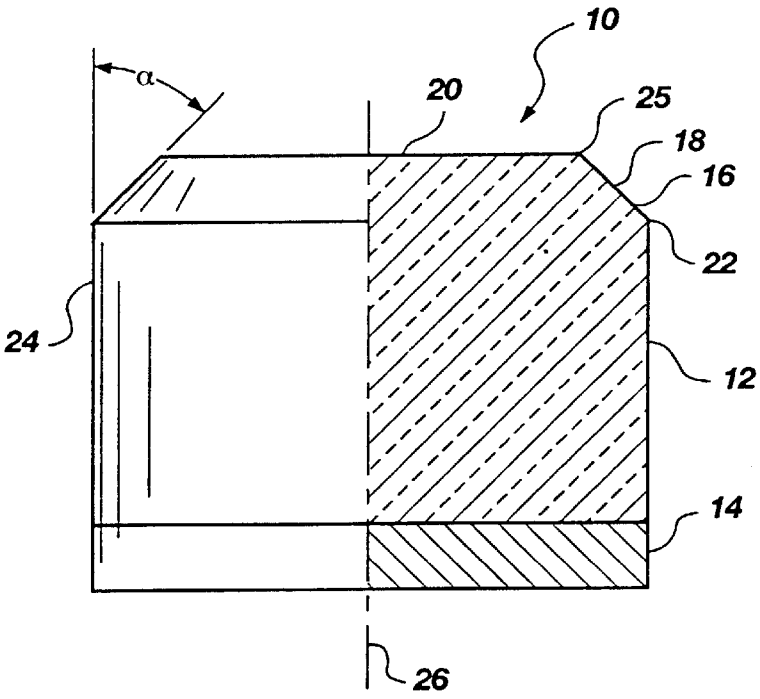
FIG. 1A is a partial cross-sectional view of a first embodiment of a cutting element in accordance with the present invention.

FIG. 1A illustrates a first embodiment of a cutting element 10 in accordance with the present invention. The cutting element 10 is comprised of a diamond cutting structure 12 (also referred to as a diamond table), preferably made from polycrystalline diamond, and a substrate 14 formed of a cemented carbide such as tungsten carbide, or other suitable material such as a ceramic or ceramet. In lieu of polycrystalline diamond, other superabrasive materials may be employed, such as diamond films, cubic boron nitride and a structure predicted in the literature as $C_3N_4$ as being equivalent to known superabrasive materials. The cutting element 10 is shown as having a generally cylindrical perimeter with a frustoconical inward taper 16 at the proximal end 18. This taper 16 may be necessary to reduce the likelihood of the cutting face 20 being damaged by impact during drilling, and to direct forces encountered during drilling toward the center of the diamond cutting structure 12. The angle $\alpha$ may range preferably from approximately 10° to 80° with respect to sidewall 24, which in this instance, lies parallel to longitudinal axis 26, and the taper 16 may extend the entire length of the diamond cutting structure 12. A small chamfer or radius may also be employed at edge 22 and/or at edge 25 at the boundaries of taper 16.

The diamond cutting structure 12 is formed to substrate 14 during fabrication, as known in the art. As illustrated, the volume of the diamond cutting structure 12 is at least as great, and preferably greater, than the volume of the substrate 14. Such a configuration, particularly when manifested as shown by a diamond table of substantial depth in the longitudinal direction (e.g., substantially transverse to the direction of cut), keeps the substrate 14 from contacting the formation as the diamond cutting structure 12 wears. Thus, a maximum amount of diamond is exposed to the formation for cutting purposes, and provides the previously enumerated advantages. Diamond cutting structure 12, while shown as a cylinder, may in fact comprise any configuration and cross-sectional shape. Moreover, the diamond volume may be uniform, e.g., fabricated of a single diamond feedstock of a particular size or size range, or may be formed of different feedstock of different sizes, or of preformed diamond structures sintered or otherwise bonded together to define the cutting structure 12. Structure 12 may also be formed as layers of different (in structure, size, wear resistance, etc.) diamond materials, or as strips, rings or other segments of different materials. In such a manner, load capacity and wear resistance may be altered as desired or required by the nature of the formation to be drilled.

In comparison, a prior art cutting element 30 as shown in FIG. 1B is comprised of a diamond cutting structure or table 32 that usually has a depth much less than the size of the supporting substrate 34. In reality, the thickness of diamond table 32 is far less than shown relative to the substrate, on the order of 0.030 inch or less, although diamond tables of up to 0.118 inch have been proposed. See U.S. Pat. No. 4,792,001. Even in the case of an extremely thick conventional diamond table, as diamond wears from the cutting element 30, the supporting substrate 34 comes in contact with the formation being drilled, forming a wear flat which quickly increases in area, reduces the cutting efficiency of the drill bit, and increases friction and frictionally-induced heating of the cutting element. Further, the thin diamond tables of the prior art result in a relatively high thermal gradient across the diamond table in comparison to the cutting elements of the invention. Moreover, because the substrate 34 is substantially exposed to the heat associated with drilling, greater thermal stresses exist between the cutting structure 32 and the substrate 34 as compared to the cutting elements of the present invention. Chamfers such as chamfer 36 have been incorporated into diamond cutting elements, but have been of insignificant width and are primarily used to interrupt the otherwise 90° cutting edge between the cutting face 38 and the outer surface 40 to protect the cutting edge from impact-induced damage before substantial cutting element wear occurs.

Figure 2A:
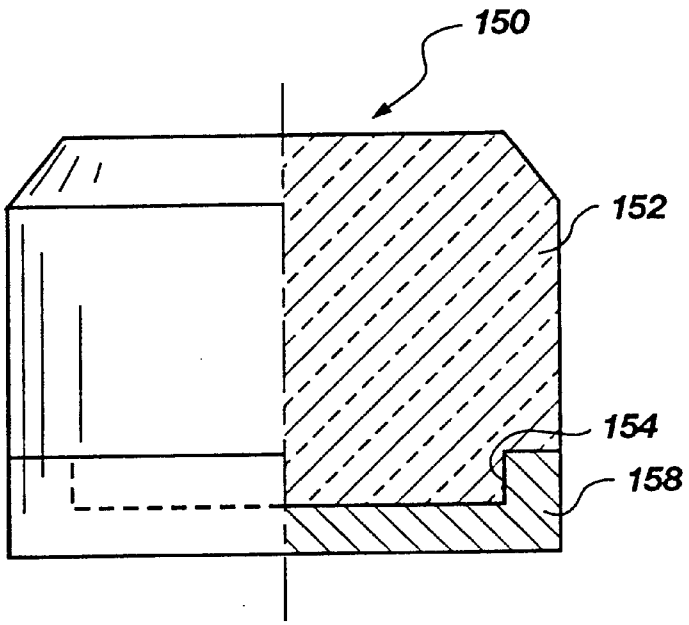
FIG. 2A is a partial cross-sectional view of a variation of the second embodiment of the cutting element of FIG. 2.
Figure 2:
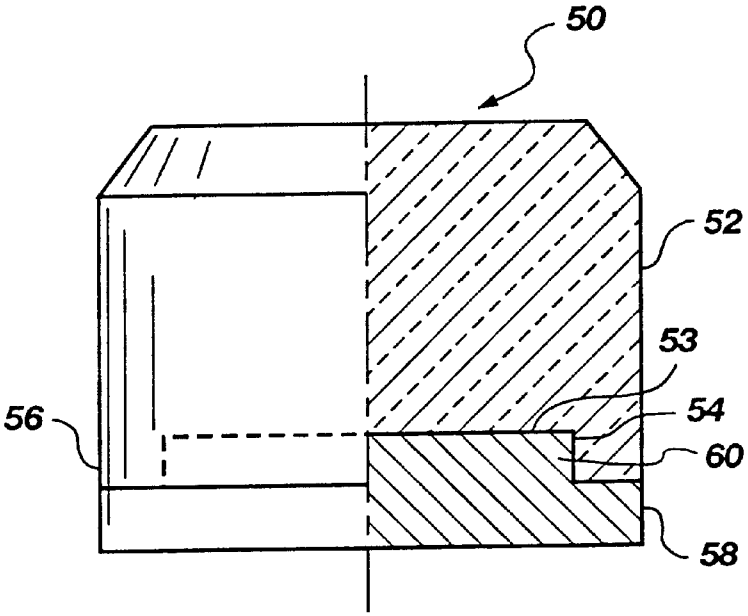
FIG. 2 is a partial cross-sectional view of a second embodiment of a cutting element in accordance with the present invention.

As shown in FIG. 2, a second embodiment of a cutting element 50 is illustrated. In this embodiment, however, the diamond cutting structure 52 defines a recess 54 at its distal end 56 having an inner surface 53. The recess 54 is shown as being substantially cylindrical in nature and concentric with the rest of the cutting element 50. The substrate 58 includes a raised portion 60 sized and shaped to be matable with the recess 54 to form a male-female-type interconnection which provides high shear strength at the diamond table/substrate interface. The substrate 58 and the diamond cutting structure 52 are bonded together during formation of the cutting element 50 as known in the art. The illustrated structure is practical, despite the differences in coefficients of thermal expansion between the two materials, due to the large mass or volume of diamond which promotes heat transfer and reduces the temperature gradient across the length of the cutting element, minimizing stresses at the table/substrate interface.

FIG. 2A depicts a variation of the structure of FIG. 2. In this case, cutting element 150 includes a diamond or other superabrasive cutting structure 152 which extends into a recess 154 in cup-shaped substrate 158 to form a male-female-type interconnection.

Figure 3:
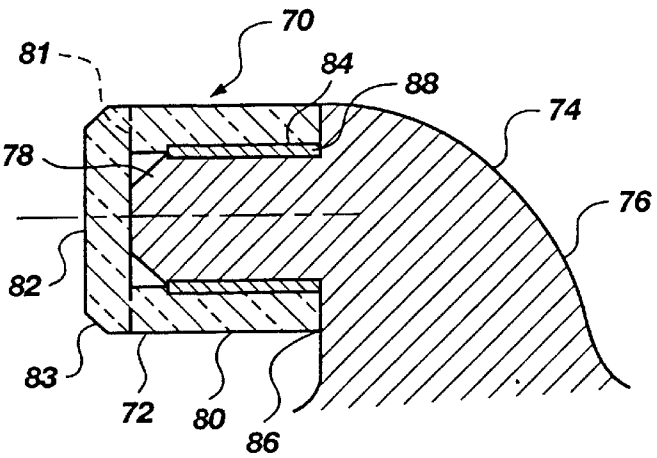
FIG. 3 is a cross-sectional view of a third embodiment of a cutting element in accordance with the present invention.

Referring now to FIG. 3, another embodiment of a cutting element 70 is shown. The cutting element 70 is comprised of a cup-shaped diamond cutting structure 72 and a carrier 74. The carrier 74 (commonly referred to as a stud or post) includes a support member 76 and an attachment member 78 depending from the support member 76. The attachment member 78 (as shown) is of a generally cylindrical configuration. The diamond cutting structure 72 has a substantially cylindrical outer perimeter 80 and a cutting face 82, both of which may be polished to help reduce friction. A large chamfer 83 (as shown) may be employed on cutting face 82. The cutting structure 72 also includes a recess 84 formed in its distal end 86 sized and shaped to snugly receive the attachment member 78. As illustrated, the diamond cutting structure 72 basically fits like a cap over the attachment member 78. The diamond cutting structure 72 may be bonded or brazed as shown at 88, or even shrink fit to the attachment member 78 by methods known in the art. It is also contemplated that element 88 be a carbide sleeve to accommodate the braze employed to secure the cutting element to the bit. A carbide sleeve 88 might completely, or only partially, encompass attachment member 78. It is further contemplated that element 88 be a single or multilayer metal coating to facilitate in-furnace bonding to the bit body during formation, such coating being disclosed in U.S. Pat. No. 5,049,164, assigned to the assignee of the present invention and incorporated herein by this reference. It is contemplated that attachment member 78 may be non-cylindrical, or even non-symmetrical, and that the recess 84 of cutting structure 72 may be formed to mate therewith. As alluded to previously, the present invention is geometry-independent, and is thus free of design limitations other than those imposed by the designer to effectuate a particular purpose associated with the cutting performance or mounting regime of the cutting element.

Figure 4:
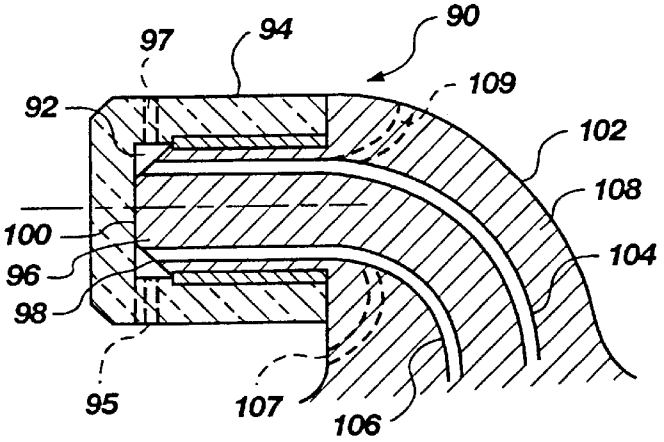
FIG. 4 is a cross-sectional view of a fourth embodiment of a cutting element in accordance with the present invention.

Similar to the embodiment shown in FIG. 3, FIG. 4 illustrates an additional use for a gap or void 92 formed between the diamond cutting structure 94 and the attachment member 96 of the cutting element 90. The gap 92 is a result of a frustoconical inward taper 98 at the proximal end 100 of the attachment member 96. Because of its cylindrical nature, the gap 92 forms an annular chamber between the cutting structure 94 and the attachment member 96. The carrier 102 is formed with channels 104 and 106 that extend through the support member 108 and through the attachment member 96 to be in fluid contact with the gap or chamber 92. A fluid, such as drilling fluid, can then be passed through the channel 104, into the gap 92 to promote heat transfer from the cutting structure, and circulated out through channel 106. It is also contemplated that the channels may comprise grooves formed on the exterior of attachment member 96 or on the interior of cutting structure 94, in either case, communicating with passages extending through support member 108. It is further contemplated that a single channel 104 to supply fluid may be employed extending into cutting structure 94, and that an aperture be formed in cutting structure 94 as shown in broken lines at 95 or 97 for fluid to exit after heat is transferred to it. Alternatively, channel 106 may exit from the bit body (support member 108) as shown in broken lines at 107, rather than returning to the interior. Another alternative is to employ a channel such as channel 106 to supply fluid, and configure channel 104 to exit the bit body (support member 108) as shown at 109. Additional fluid-type cutting element cooling arrangements are disclosed in U.S. Pat. No. 5,316,095, assigned to the assignee of the present invention and incorporated herein by this reference.

Figure 5:
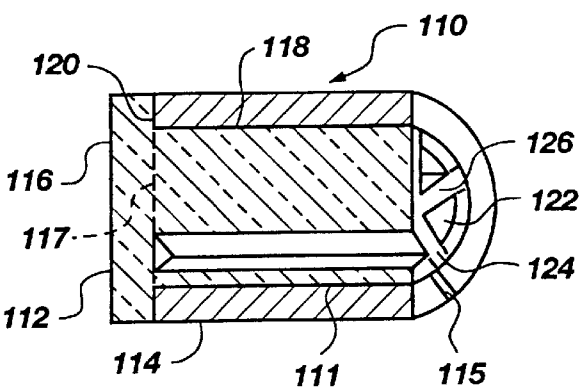
FIG. 5 is a cross-sectional perspective view of a fifth embodiment of a cutting element in accordance with the present invention.

FIG. 5 shows an alternate embodiment of a cutting element 110. In this embodiment, the cutting element 110 includes a substantially cylindrical cutting structure 112 and an attachment sleeve 114. At the cutting face 116, the cutting structure 112 has a diameter greater than its diameter at the location of the sleeve 114. The sleeve 114 is sized and shaped to snugly fit over the portion 118 of the cutting structure 112 having a reduced circumference or periphery 111. In this manner, the cutting face 116 extends over the proximal end 120 of the sleeve 114 so that, due to the thickness or depth of the cutting face 116, the sleeve 114 does not come into cutting contact with the formation. It is contemplated that sleeve 114 would preferably include an expansion split or slit 115 to accommodate thermally-induced expansion and contraction and the differences in CTE between the superabrasive and sleeve materials. It is also contemplated that the sleeve 114 be substantially full-length, as shown, or of an abbreviated length, as well as of any suitable thickness. Perforated sleeves, and helical sleeves, as well as those of other configurations, are also contemplated.

The cutting structure 112 is also formed with a plurality of cavities or recesses 122 longitudinally extending from a distal end 124 into the cutting structure 112. The recesses 122 help to direct heat generated during drilling along the fins 126 and away from the cutting face 116, and may be used to contain a stationary or flowing heat-transfer fluid. Moreover, the circumferentially outer portion of distal end 124 may be deleted, sleeve 114 then directly contacting the outer edges of fins 126 as shown in broken lines.

Figure 6:
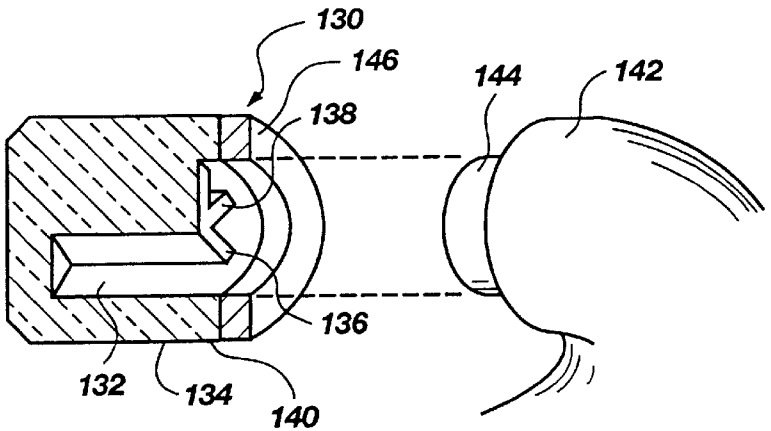
FIG. 6 is a cross-sectional perspective view of a sixth embodiment of a cutting element in accordance with the present invention.

In a similar configuration, the cutting element 130 shown in FIG. 6 includes a plurality of pie-segment or wedge-shaped cavities 132 extending into the cutting structure 134. The distal ends 136 of the fins 138, however, formed by the cavities 132 are recessed into the distal end 140 of the cutting structure 134. Being recessed, the cutting structure 134 can then be attached to (placed over) a carrier element 142 having an attachment member 144. An attachment ring 146 may optionally be bonded during cutter fabrication to the distal end 140 of the cutting structure 134 to, in turn, be bonded as by brazing to the carrier element 142.

Figure 8:
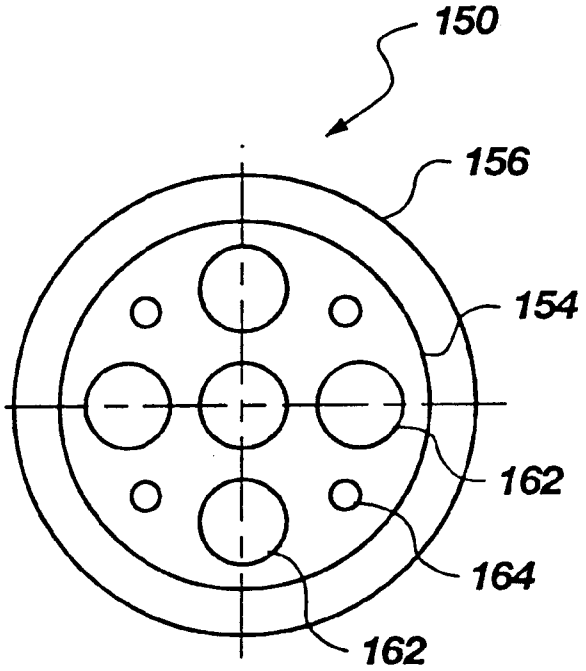
FIG. 8 is a schematic rear view of the embodiment shown in FIG. 7.
Figure 7:
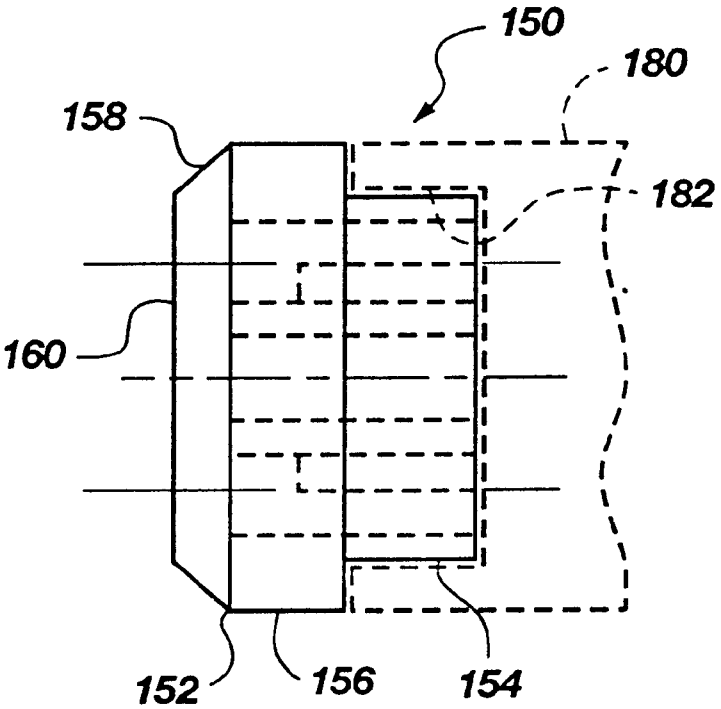
FIG. 7 is a schematic side view of a seventh embodiment of a cutting element in accordance with the present invention.

The embodiments shown in FIGS. 7 and 8 illustrate an alternate configuration to that of FIG. 5. That is, the cutting structure 152 of the cutting element 150 may comprise many different configurations without departing from the scope of the invention. For example, the cutting structure 152 may be mushroom-shaped, having a stem 154 and a cap 156. The cap 156 includes a frustoconical inward taper 158 proximate a cutting face 160 and is at least as long as the stem 154. Such a cutting structure 152 could then be mounted to a sleeve, such as sleeve 114 shown in FIG. 5, or to a ring-shaped attachment member of a carrier element.

FIGS. 7 and 8 also illustrate that many different sizes and shapes of recesses or cavities 162 and 164 may be incorporated into the cutting structure. For example, cavities 162 and 164 are of different cross-sectional sizes and shapes than the cavities 122 and 132 of FIGS. 5 and 6, respectively. Moreover, as specifically shown in FIG. 7, the depth of the cavities 162 and 164 may vary. Such cavities 162 and 164 could also be placed in fluid communication with each other and/or a carrier element, such as carrier 102 in FIG. 4. A carrier 180 having a recess 182 in its proximal end (shown in broken lines) may be employed with cutting element 150.

The previously-described diamond cutting structures have been depicted as comprising single-piece diamond volumes or masses. It should be noted that this is not a requirement of the invention and, for example, cutting face 82 and perimeter 80 of cutting structure 72 (FIG. 3) may be separately formed as shown at broken line 81 and later combined. Similarly, cutting face portion 116 and trailing portion 118 of cutting structure 112 (FIG. 5) may be separately formed as shown at broken line 117, for ease of manufacture. The other embodiments of the invention may similarly be formed in two or more components of superabrasive material, and subsequently combined to define the cutting element or a portion thereof. Diamond structures may be bonded to each other in ultra-high pressure presses, as those used to form the separate components themselves, or metallurgical bonds may be employed where acceptable, such as when shear stresses are negligible or other mechanical structure accommodates such stresses.

Figure 9:
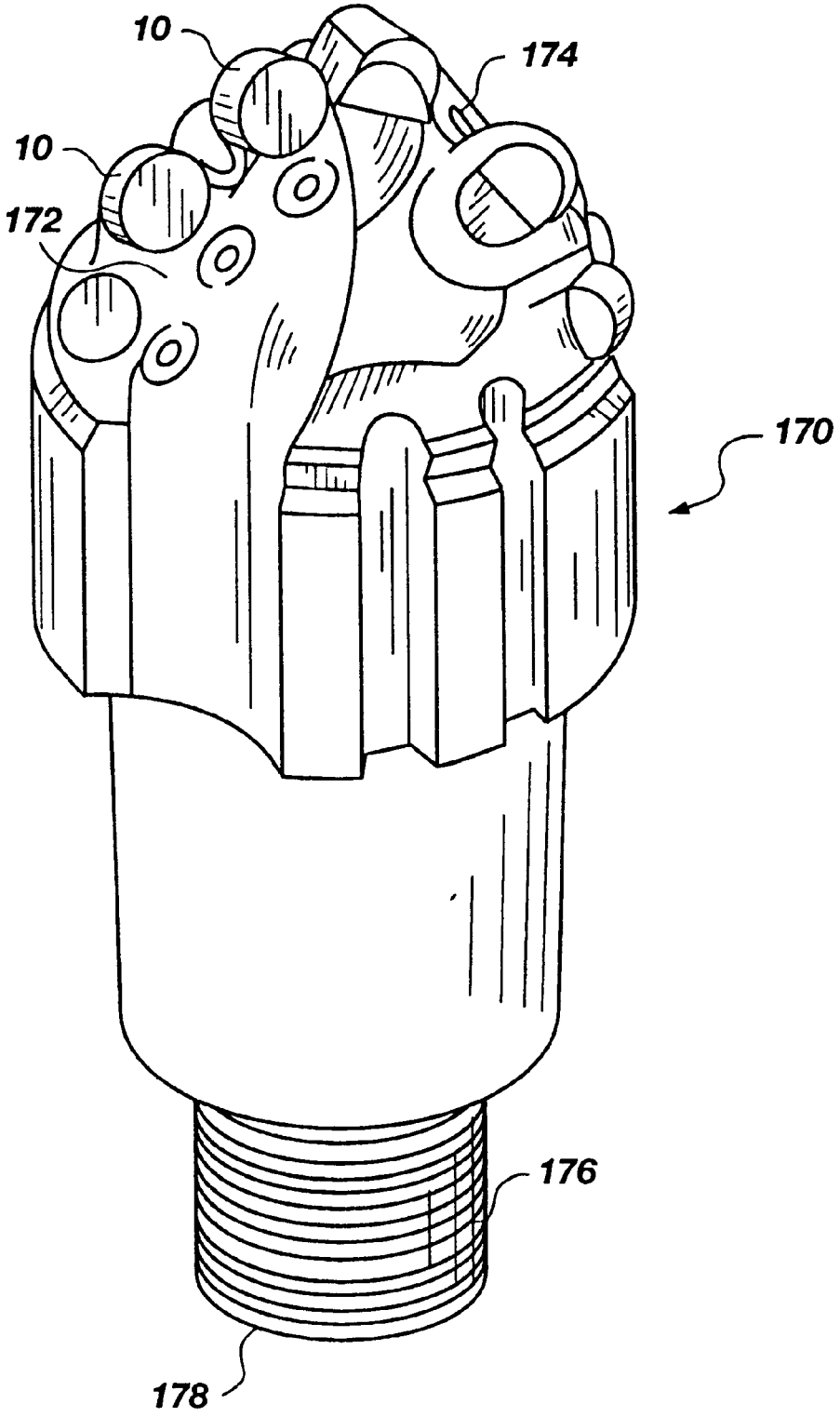
FIG. 9 is a typical rotary drag bit used as a potential carrier or platform for PDC cutting elements such as those of the present invention.

As shown in FIG. 9, the various cutting elements, such as element 10, described herein are contemplated as being adaptable to any rotary-type drill bit, such as a typical rotary-drag bit 170. As shown, the bit 170 has a face 172 at a distal end 174 to which the cutting elements 10 are attached, and a threaded attachment structure 176 at a proximal end 178 for attachment to a drill string as known in the art.

As alluded to previously, those skilled in the art will appreciate that channels or passageways may be formed in the diamond material of the cutting elements, in the substrate material, or partially formed in both. Also, the substrate material may be machined, while the diamond material may be etched or electro-discharge machined (EDM), or ground on a diamond wheel. Fluid may be provided to the channels or passageways individually, or from a central feed point via a manifold arrangement. The structure may also include a carrier element having a fluid feed passage or passages for the channels or passageways.

It should be understood that the present invention is not limited to diamond cutters commercially available on the market, but may also be easily adapted to cutting elements comprising a diamond film, and in fact may be especially suited for use with same due to the ease with which passageways and channels may be formed in the film, or a film deposited to define such cavities. Finally, it will be appreciated that the present invention is equally applicable to diamond cutting elements of both uniform and non-uniform thickness or depth, and of any configuration.

While the present invention is disclosed herein in terms of preferred embodiments employing PDC cutting elements, it is believed to be equally applicable to other superabrasive materials such as boron nitride, silicon nitride and diamond films.

It will be appreciated by one of ordinary skill in the art that one or more features of the illustrated embodiments may be combined with one or more features from another to form yet another combination within the scope of the invention as described and claimed herein. While certain representative embodiments and details have been shown for purposes of illustrating the invention, it will be apparent to those skilled in the art that various changes in the invention disclosed herein may be made without departing from the scope of the invention, which is defined in the appended claims. For example, various shapes and sizes of cutter substrates and diamond tables may be utilized; the angles and contours of any beveled or chamfered edges may vary; a dome-shaped or conical cutting face may be employed and the relative size and shape of any component may be changed. Moreover, the features of the present invention may be employed in half-round, quarter-round, or "tombstone" shaped or polygonal (symmetric or asymmetric) cutting elements to great advantage, and the shape of the cutting surface and the configuration of the cutting surface edge or edges of the diamond table may be varied as desired without diminishing the advantages or utility of the invention.

What is claimed is:

1. A cutting element for use on a drill bit for drilling a subterranean formation, comprising:

a volume of superabrasive material defining a one-piece, two-dimensional superabrasive cutting face including a superabrasive cutting edge at a lateral periphery thereof; and a member comprising a volume of non-superabrasive material secured to said volume of superabrasive material, for securing said cutting element to said drill bit;

wherein said cutting element has a longitudinal axis and said volume of superabrasive material comprises a predominant volume of said cutting element having a depth of at least about 0.150 inch measured with respect to said longitudinal axis, extending between said cutting face proximate said cutting edge and any portion of said volume of non-superabrasive material of said member exposed on an exterior surface of said cutting element.

2. The cutting element of claim 1, wherein said volume of superabrasive material is substantially cylindrical in cross-section.

3. The cutting element of claim 2, wherein said member is substantially annular.

4. The cutting element of claim 3, wherein said substantially annular member is secured to said volume of superabrasive material proximate an end thereof opposite said cutting face, taken with respect to said longitudinal axis.

5. The cutting element of claim 2, wherein said substantially annular member comprises a sleeve through which a portion of said volume of superabrasive material extends.

6. The cutting element of claim 5, wherein said volume of superabrasive material extends laterally at least as far as an exterior surface of said substantially annular member proximate said cutting edge.

7. The cutting element of claim 3, further including at least one cavity at least partially within said volume of superabrasive material and extending through said substantially annular member to an end of said cutting element opposite said cutting face.

8. The cutting element of claim 2, wherein said member is substantially circular.

9. The cutting element of claim 8, wherein said substantially circular member includes a protrusion extending into said volume of superabrasive material.

10. The cutting element of claim 8, wherein said substantially circular member includes a recess defined within a laterally peripheral wall, into which a portion of said volume of superabrasive material extends.

11. The cutting element of claim 1, wherein said volume of superabrasive material includes a recess therein opposite said cutting face, said member being at least partially received in said recess.

12. The cutting element of claim 11, wherein said volume of superabrasive material extends laterally beyond said member proximate said cutting edge.

13. The cutting element of claim 1, further including at least one void within said cutting element.

14. The cutting element of claim 13, wherein said at least one void opens onto an exterior surface of said cutting element remote from said cutting face.

15. The cutting element of claim 14, wherein said at least one void is defined wholly within said volume of superabrasive material.

16. The cutting element of claim 14, wherein said at least one void is defined at least in part between said volume of superabrasive material and said member.

17. A drill bit for drilling a subterranean formation, comprising:

a bit body having a first end defining a face and a second end having a connecting structure associated therewith; and a plurality of cutting elements attached to said bit body over said face, at least one of said cutting elements including:

a volume of superabrasive material defining a one-piece, two-dimensional superabrasive cutting face including a superabrasive cutting edge at a lateral periphery thereof; and a member comprising a volume of non-superabrasive material secured to said volume of superabrasive material, for securing said cutting element to said drill bit;

wherein said at least one cutting element has a longitudinal axis and said volume of superabrasive material comprises a predominant volume of said at least one cutting element having a depth of at least about 0.150 inch measured with respect to said longitudinal axis, extending between said cutting face proximate said cutting edge and any portion of said volume of non-superabrasive material of said member exposed on an exterior surface of said at least one cutting element.

18. The drill bit of claim 17, wherein said volume of superabrasive material is substantially cylindrical in cross-section.

19. The drill bit of claim 18, wherein said member is substantially annular.

20. The drill bit of claim 19, wherein said substantially annular member is secured to said volume of superabrasive material proximate an end thereof opposite said cutting face, taken with respect to said longitudinal axis.

21. The drill bit of claim 19, wherein said substantially annular member comprises a sleeve through which a portion of said volume of superabrasive material extends.

22. The drill bit of claim 21, wherein said volume of superabrasive material extends laterally at least as far as an exterior surface of said substantially annular member proximate said cutting edge.

23. The drill bit of claim 19, further including at least one cavity at least partially within said volume of superabrasive material and extending through said substantially annular member to an end of said cutting element opposite said cutting face.

24. The drill bit of claim 18, wherein said member is substantially circular.

25. The drill bit of claim 24, wherein said substantially circular member includes a protrusion extending into said volume of superabrasive material.

26. The drill bit of claim 24, wherein said substantially circular member includes a recess defined within a laterally peripheral wall, into which a portion of said volume of superabrasive material extends.

27. The drill bit of claim 17, wherein said volume of superabrasive material includes a recess therein opposite said cutting face, said member being at least partially received in said recess.

28. The drill bit of claim 27, wherein said volume of superabrasive material extends laterally beyond said member proximate said cutting edge.

29. The drill bit of claim 17, further including at least one void within said cutting element.

30. The drill bit of claim 29, wherein said at least one void opens onto an exterior surface of said at least one cutting element remote from said cutting face.

31. The drill bit of claim 30, wherein said at least one void is defined wholly within said volume of superabrasive material.

32. The drill bit of claim 30, wherein said at least one void is defined at least in part between said volume of superabrasive material and said member.

* * * * *

(Also Form PTO-1050)

UNITED STATES PATENT AND TRADEMARK OFFICE

CERTIFICATE OF CORRECTION

PATENT NO : 5,924,501

DATED : July 20, 1999

INVENTOR(S) : Gordon A. Tibbitts

It is certified that error appears in the above-identified patent and that said Letters Patent are hereby corrected as shown below:

Column 1, line 7, after "elements" delete the comma;

Column 1, line 7, after "and" insert a comma;

Column 1, line 7, after "specifically" insert a comma;

Column 6, line 17, after "invention" delete the comma;

Column 7, line 11, after "drilling" delete the comma; and

Column 7, line 15, after "which" insert a comma.

Signed and Sealed this

Thirtieth Day of May, 2000

*Attest:*

Q. TODD DICKINSON

*Attesting Officer*

*Director of Patents and Trademarks*